US008006425B2

(12) United States Patent
Burt et al.

(10) Patent No.: US 8,006,425 B2
(45) Date of Patent: Aug. 30, 2011

(54) FOLDABLE FIREARM

(75) Inventors: Eric C. Burt, Broomfield, CO (US); Richard M. Fitzpatrick, Denver, CO (US); Michael T. Mayberry, Denver, CO (US)

(73) Assignee: Magpul Industries Corp., Boulder, CO (US)

( * ) Notice: Subject to any disclaimer, the term of this patent is extended or adjusted under 35 U.S.C. 154(b) by 183 days.

(21) Appl. No.: 12/420,019

(22) Filed: Apr. 7, 2009

(65) Prior Publication Data

US 2009/0277066 A1 Nov. 12, 2009

Related U.S. Application Data

(60) Provisional application No. 61/043,114, filed on Apr. 7, 2008.

(51) Int. Cl.
*F41C 23/00* (2006.01)

(52) U.S. Cl. ..... 42/73; 42/7; 42/1.09

(58) Field of Classification Search ..... 42/6, 7, 42/17, 73, 1.09, 1.11
See application file for complete search history.

(56) References Cited

U.S. PATENT DOCUMENTS 4,625,621 A * 12/1986 Warin ..... 89/197

OTHER PUBLICATIONS

M-21 and ARES FMG. Jan. 10, 2006.< http://ksatria.edublogs.org/2006/01/10/ares-fmg-folding-submachine-gun/> and <http://ksatria.edublogs.org/2006/01/> and <http://ksatria.edublogs.org>.*

* cited by examiner

*Primary Examiner* — Gabriel Klein
(74) *Attorney, Agent, or Firm* — Geoffrey E. Dobbin

(57) ABSTRACT

The present invention is a spring-biased folding firearm that stows compactly and safely. The firearm has three main components: a stock, a receiver and a grip/magazine combination. In folding, the stock folds over the receiver, sandwiching the grip/magazine between the components. When folded, the magazine over-inserts into the grip housing, allowing the stock to clear and providing additional safety when stowed by isolating the ammunition feed. A buttplate latches over the open joint to contain the unit and further secure it. When stowed, the bolt is disengaged from the ammunition feed supply, preventing accidental firing, so a loaded round can be safely carried in the chamber—allowing for immediate use of the firearm upon opening. The weapon is deployed through single-handed actuation and is spring-assisted into firing position. Currently the firearm uses readily available after-market parts for easier replacement if necessary and does contain hardware for mounting accessories.

19 Claims, 10 Drawing Sheets

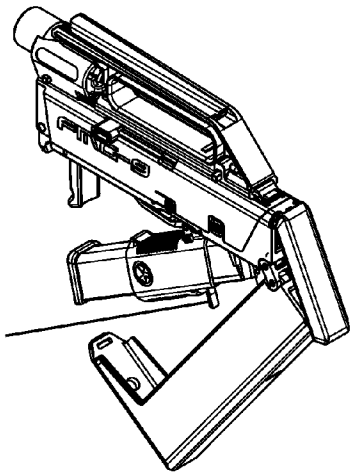
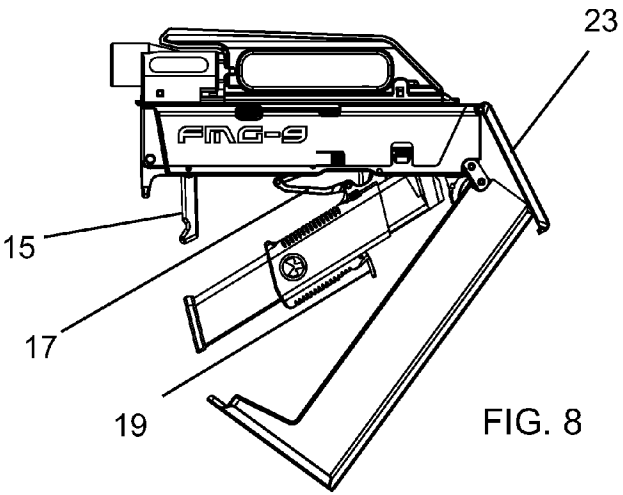
FIG. 8
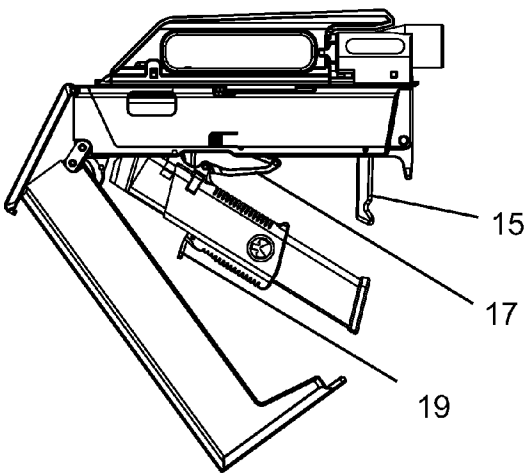
FIG. 9

FOLDABLE FIREARM

CROSS-REFERENCES TO RELATED APPLICATIONS

This Application is a non-provisional perfection of earlier filed U.S. Provisional Application No. 61/043,114, filed Apr. 7, 2008 and claims priority on the same, the prior application being incorporated by reference, in its entirety, herein.

FIELD OF THE INVENTION

The present invention relates to the field of firearms and more particularly relates to a firearm that folds into a compact storage mode while capable of deploying rapidly.

BACKGROUND OF THE INVENTION

Folding firearms are known in the prior art. Folding firearms are to be distinguished from weapons where a mere component, like a butt stock, folds over the weapon. Rather folding firearms are those that fold over themselves into a compact storage package. Prior folding firearms are noted for being manually deployed, and therefore prohibitively slow in a surprise situation. They also typically feature an out-of-profile single hinge which inhibits streamlining design.

The present invention is a folding firearm that is spring loaded for rapid, single-handed, deployment and utilizes a number of components readily available for repair or replacement. The present invention also features, among other things, a combined charging/deployment handle, a closed-bolt action which allows for safe carry of a loaded round as it is disengaged from the ammunition feed when stowed, and a hinged back plate that also serves as a cheek rest. For purposes of this Application, the term "single-handed" shall mean that the weapon may be opened using the same hand in which it is held. Prior art folding weapons required the user to hold the weapon in one hand and either operate the unfolding mechanism, and/or actually unfold the weapon, with the other.

The present invention represents a departure from the prior art in that the folding firearm of the present invention allows for compact and safe storage while simultaneously providing rapid, single-handed, ready deployment.

SUMMARY OF THE INVENTION

In view of the foregoing disadvantages inherent in the known types of folding firearms, this invention provides a rapidly deployed folding firearm. As such, the present invention's general purpose is to provide a new and improved folding firearm that is spring loaded when stowed and rapidly deploys in a fire ready configuration.

To accomplish these objectives, the folding firearm comprises three main body components: a grip/magazine housing, a stock component and a receiver, containing the trigger assembly and action. Additional minor components, such as spring loaded opening assist and charging handle/latch assembly are utilized to add functionality. A folding buttplate serves to cover the joint of the weapon when folded, hold the weapon together and becomes a cheek plate when the weapon is deployed. The weapon may be made to utilize current aftermarket parts, specifically from the GLOCK line of firearms, to aid in part replacement availability.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 8 is a right plan view of the firearm OF FIG. 1, during intermediate folding stages.

FIG. 9 is a left plan view of the firearm of FIG. 8.

FIG. 10 is a rear perspective view of the firearm of FIG. 8.

DETAILED DESCRIPTION OF THE PREFERRED EMBODIMENT

Figure 1:
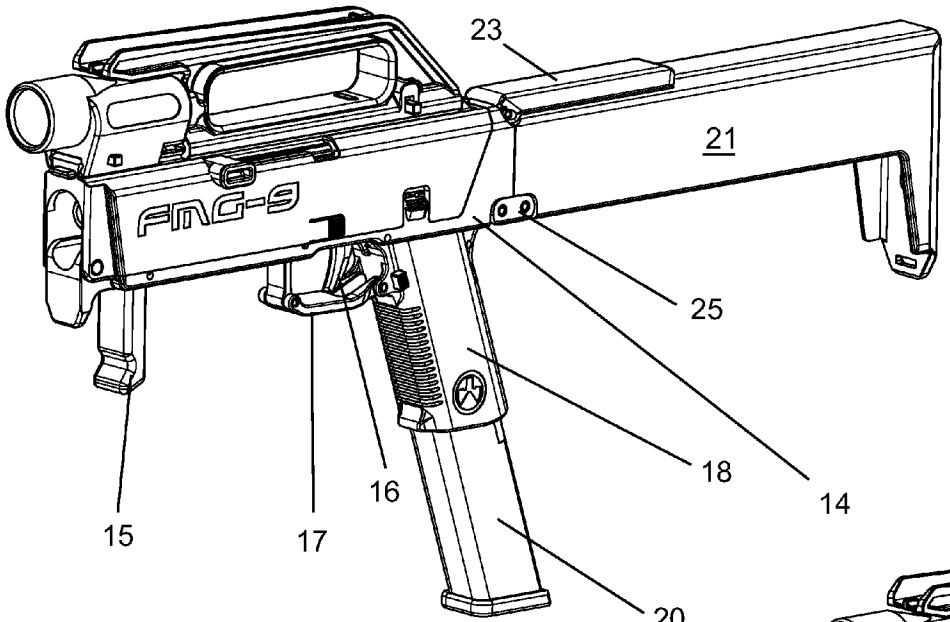
FIG. 1 is a front perspective view of the firearm according to the present invention, deployed and equipped with an optional handle and lighting assembly.
Figure 17:
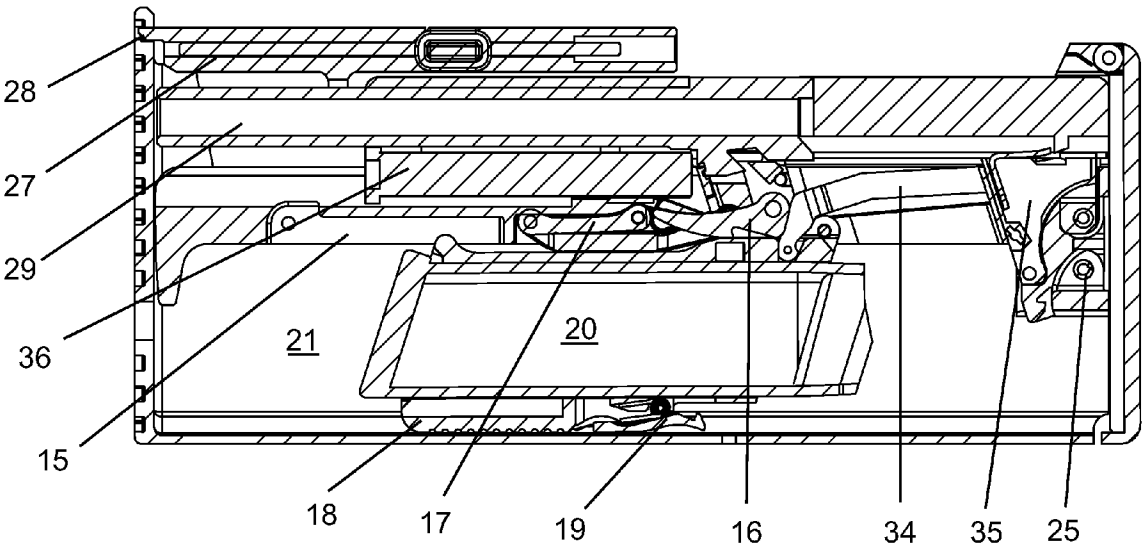
FIG. 17 is a left sectional view of the firearm of FIG. 2, with the receiver cover removed.
Figure 18:
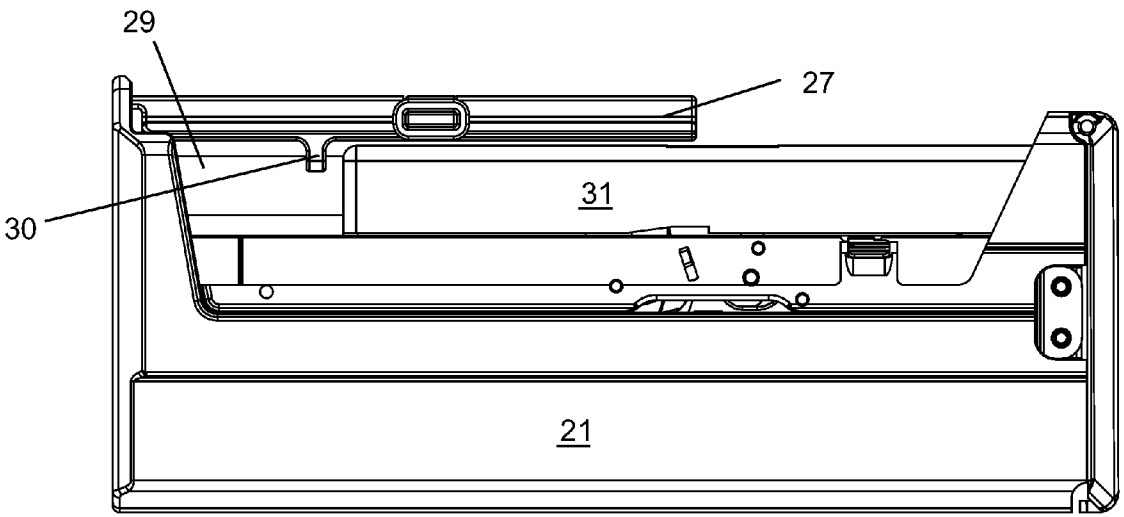
FIG. 18 is a plan view of the firearm of FIG. 17.

With reference now to the drawings, the preferred embodiment of the folding firearm is herein described. It should be noted that the articles "a", "an", and "the", as used in this specification, include plural referents unless the content clearly dictates otherwise. The following reference numerals are used throughout this specification to denote the following parts of the firearm:

10 Firearm, generally
11 Rail
12 Handle
13 Light
14 Receiver
15 Fore end grip
16 Trigger
17 Trigger Guard
18 Grip
19 Grip Latch
20 Magazine
21 Stock
22 Plate Notch
23 Back Plate
24 Hinge Springs
25 Double Hinge
26 Charging Handle Slot
27 Charging Handle
28 Spur
29 Barrel
30 Yoke
31 Slide
32 Charging Handle Return Spring
33 Charging Handle Guide Rod
34 Trigger Bar
35 Firing Mechanism (generally)
36 Guide Rod
37 Recoil Spring With reference to FIG. 1, the firearm 10 comprises a receiver 14 with a grip 18 depending therefrom. Grip 18 houses a magazine 20. Receiver 14 is hingedly attached to stock 21 at double hinge 25. The dual pivot point, a moving "virtual pivot", created by the double hinges 25 allows for in-profile placement of the double hinge 25 and allows the firearm to be folded compactly while also allows for the firearm to be unfolded across an entire 180° angle. Two torsion springs 24 (FIG. 21) are mounted on the double hinge 25 to provide opening power for the stock 21 on both rotational degrees of freedom. A trigger mechanism 16 resides distally from the receiver 14 in front of the grip 18. A back plate 23 is hingedly attached to the receiver 14 and locks into position as a cheek plate when the weapon is deployed. When deployed, the back plate 23 latches into notch 22. When stowed, the back plate covers the joint made between the receiver 14 and stock 21 and retains its position against the stock 21 under spring pressure. Receiver 14 and stock 21 are spring biased to unfold into the deployed position, while back plate 23 is spring biased to maintain a closed position, such that when engaged, the back plate 23 will counteract the natural bias of the receiver 14 and stock 21 to unfold. When folding, shown in FIGS. 17 and 18, the stock 21 folds over the grip 18, trigger mechanism 16 and magazine 20 and covers the bottom of the receiver 14. Trigger mechanism 16 collapses into the receiver and magazine 20 is drawn further into the grip 18 (particularly with large capacity magazines) as the receiver 14 disengages from the magazine 20 and grip 18. The trigger guard 17 folds over onto itself due to its hinged nature with the grip 18 and receiver 14. These actions allow stock 21 to fit over the receiver 14 and contain the above components. By disengaging from the magazine 20, receiver 14 is then stowed with only one round in the firing chamber thereby removing the possibility of multiple accidental firings as could be started from a cook-off. This condition, which is known to occur in certain machine-guns, poses a serious safety risk. When stowed with a single round in the chamber, the firing mechanism 35, and trigger bar 34 necessary to fire the weapon are disconnected from the trigger. Additionally the firing mechanism 35 (ideally a GLOCK firing mechanism) leaves the striker only partially cocked and without sufficient energy to detonate a primer until activated by a long trigger pull. As such, the weapon cannot be fired in a stowed configuration, but is ready for use, without charging, when deployed. This provides an essential balance between safety and readiness. When stowed, a spur 28 at the head of charging handle 27 resides in a slot 26 in the toe of the stock 21, capturing the stock 21 and maintaining the stowed configuration.

In unfolding, the charging handle 27 is actuated, releasing the spur 28 from stock 21. This then unleashes the springs 24 biasing the receiver 14 and stock 21, thereby causing the weapon to deploy. While deploying, the magazine 20 extends from the grip 18 and allows for interaction between the magazine 20 and receiver 14, while the trigger mechanism 16 and trigger guard 17 unfold. A fore end grip 15 is positioned towards the underside of the fore end of the receiver 14 and is spring biased to deploy. When folded, the magazine 20 and grip 18 are folded over the fore end grip 15. While deploying, the fore end grip 15 actually pushes the magazine 16 and grip 14 out and assists their deployment. When finished deploying, back plate 23 engages notch 22 and grip latch 19 engages the receiver 14. In so doing, these items lock the firearm in deployed position until the user desires to stow it.

Figure 19:
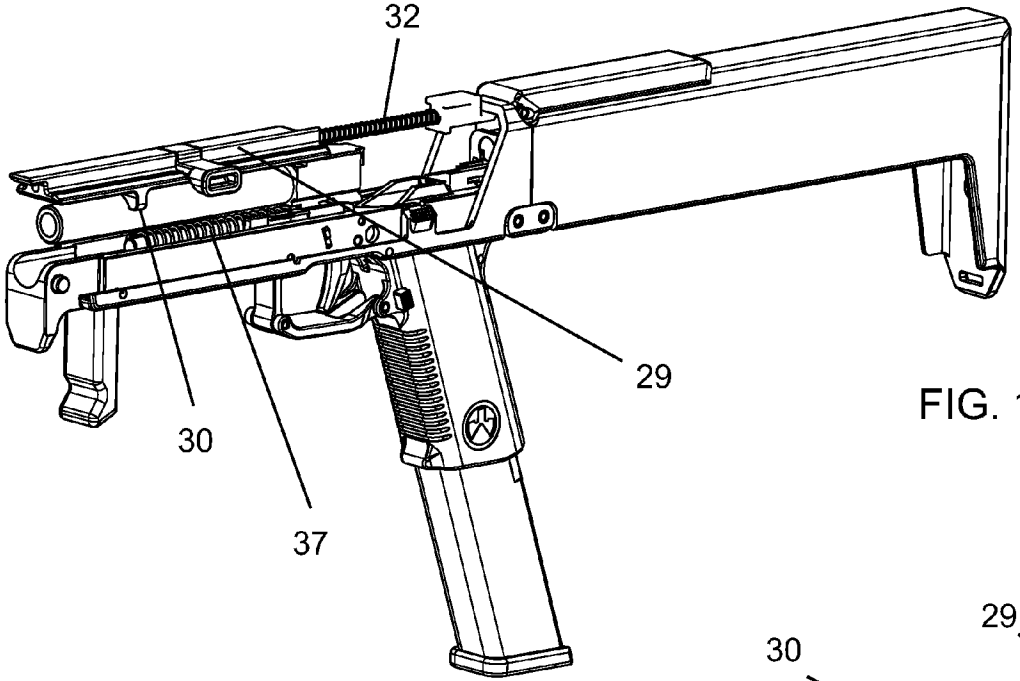
FIG. 19 is a front perspective view of the firearm of FIG. 1, the receiver cover and slide removed.
Figure 20:
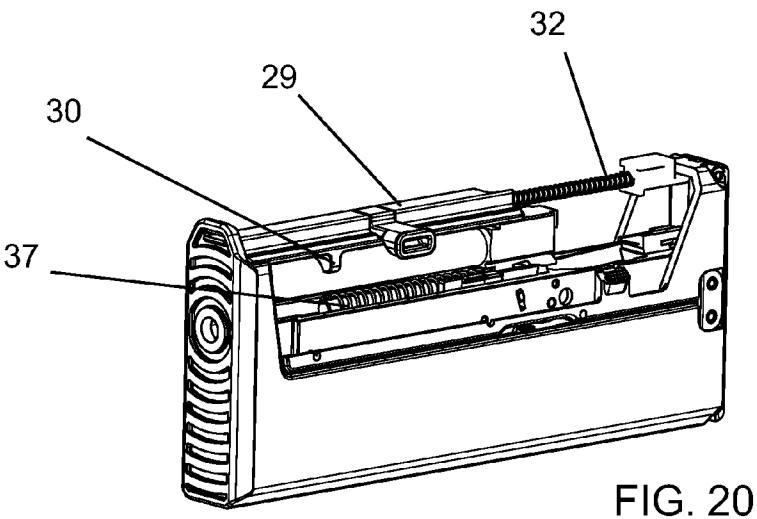
FIG. 20 is a front perspective view of the firearm of FIG. 2, the receiver cover and slide removed.
Figure 21:
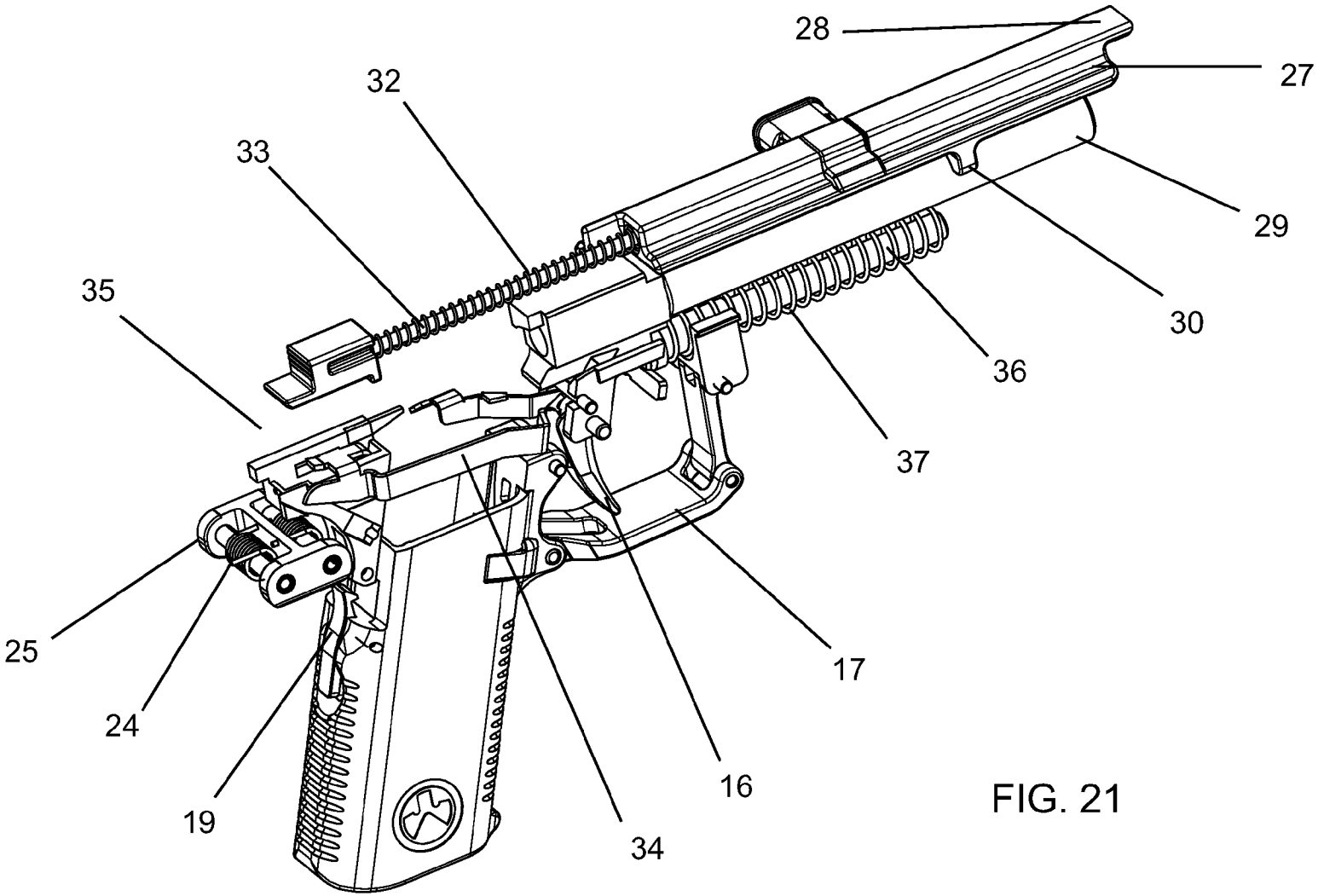
FIG. 21 is a rear perspective view of the internal mechanism of the firearm of FIG. 1.
Figure 22:
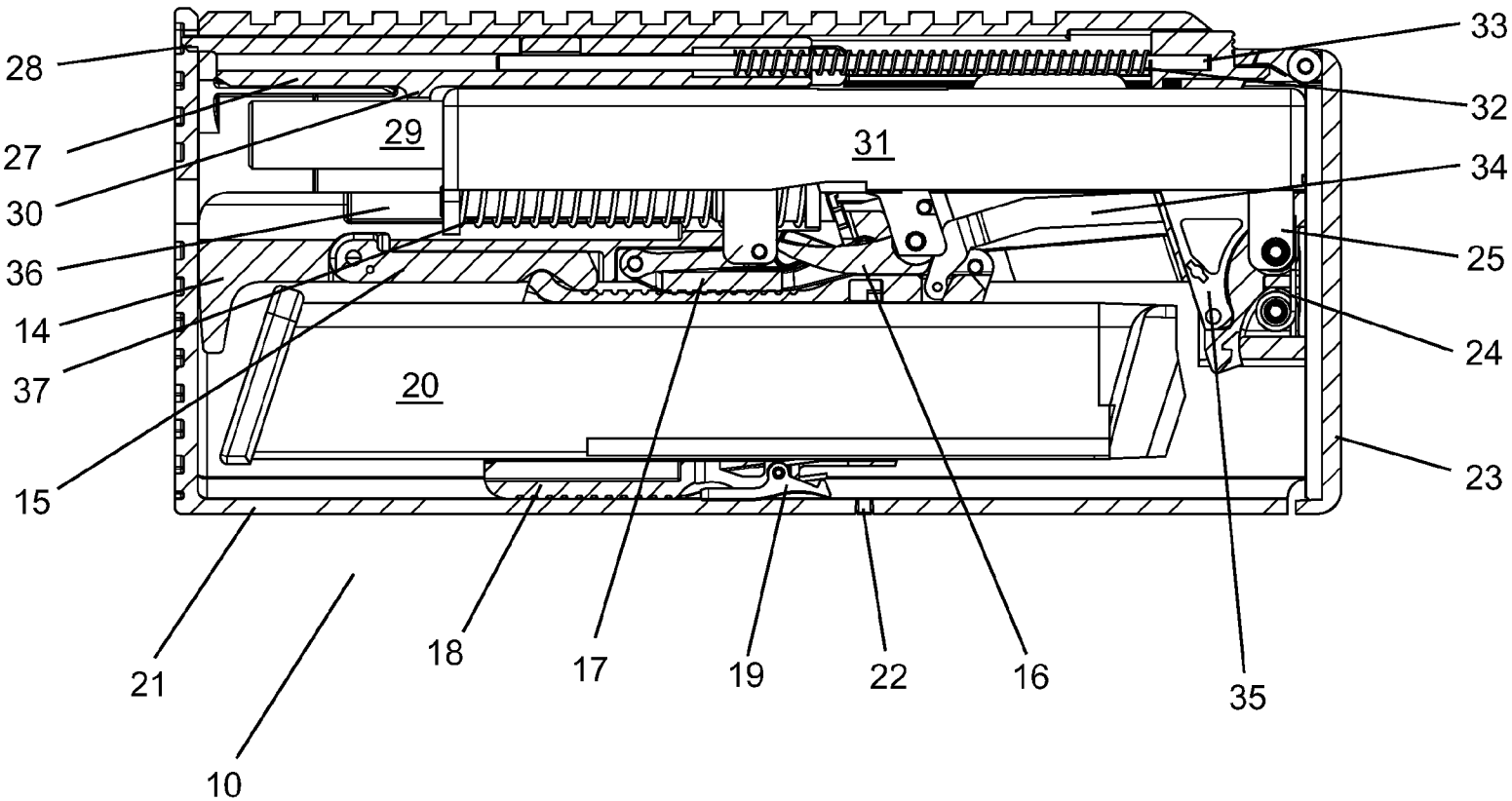
FIG. 22 is a left sectional view of the firearm of FIG. 4, with an over-inserted ammunition magazine.

As can be seen in FIGS. 19-21, the charging handle 27 is a non reciprocating handle residing over the barrel 29 and forward of the slide 31. Yoke 30 projects under charging handle 27 and rests on barrel 29. The first part of its stroke is utilized to disengage the stock 21 (by disengaging the spur 28) and initiate the deployment process, and may be actuated with a single hand. The second part of the stroke engages the slide 31 with yoke 30 and draws it rearward, which charges the weapon. Charging handle 27 progresses along guide rod 33 and is returned to its original position by spring 32.

Figure 2:
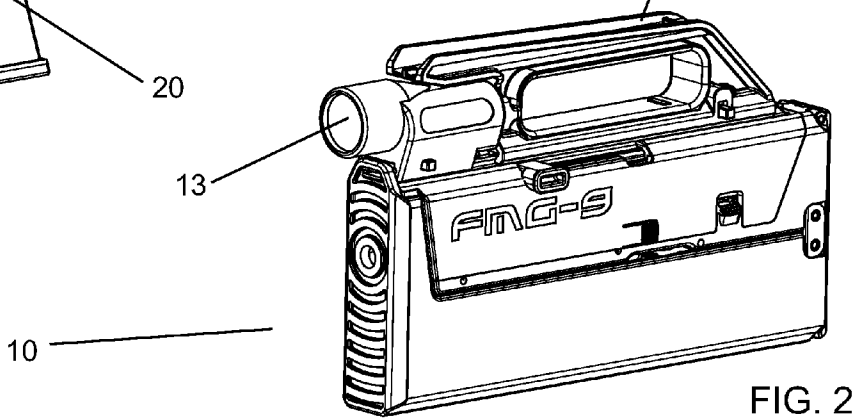
FIG. 2 is a front perspective view of the firearm of FIG. 1, stowed.
Figure 3:
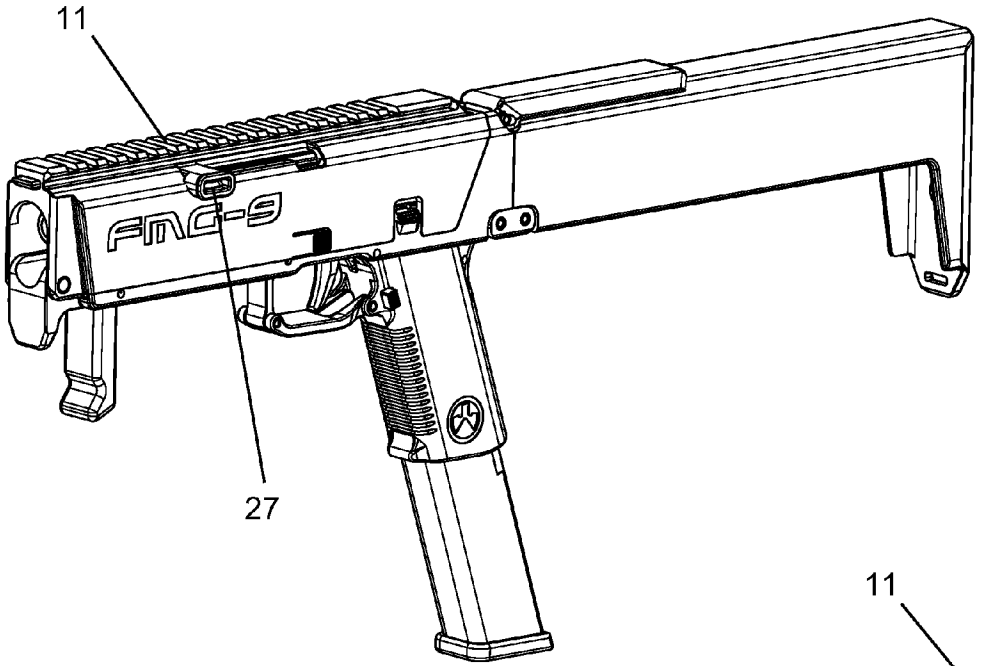
FIG. 3 is a front perspective view of the firearm of FIG. 1, unequipped.
Figure 4:
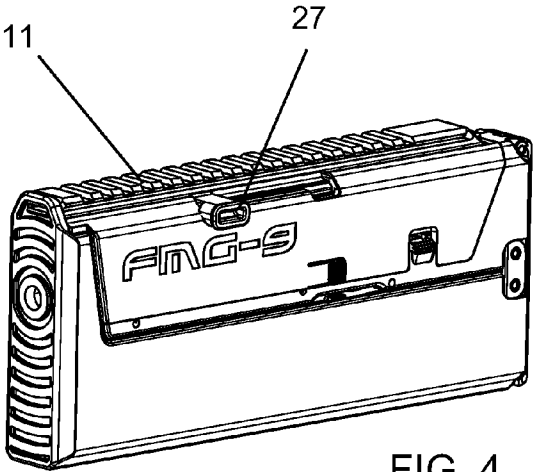
FIG. 4 is a front perspective view of the firearm of FIG. 3, stowed.
Figure 5:
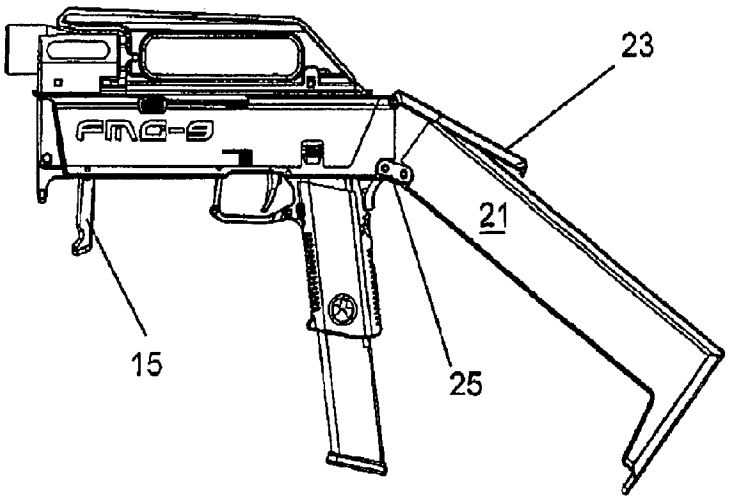
FIG. 5 is a right plan view of the firearm of FIG. 1, during initial folding stages.
Figure 6:
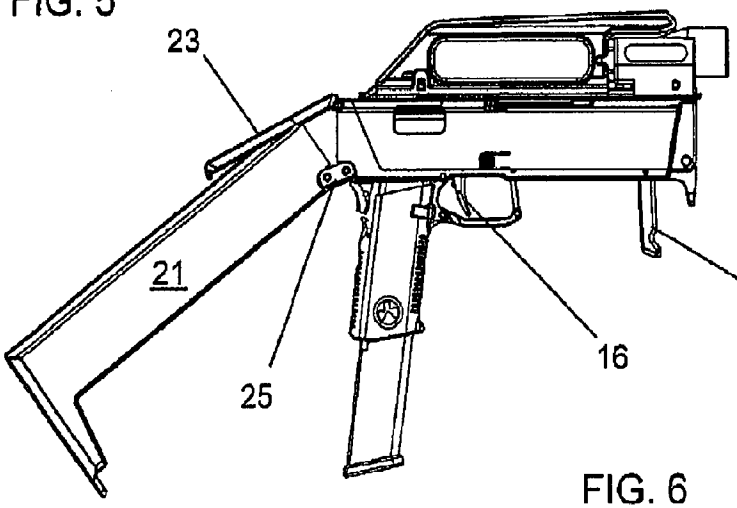
FIG. 6 is a left plan view of the firearm of FIG. 5.
Figure 7:
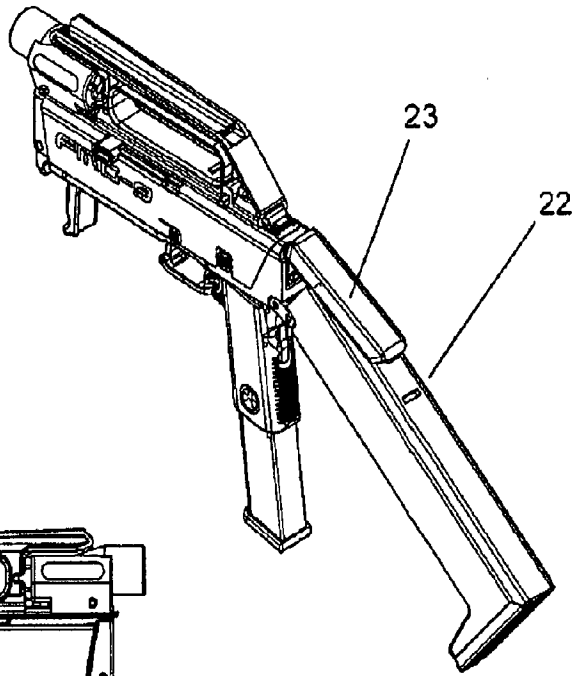
FIG. 7 is a rear perspective view of the firearm of FIG. 5.
Figure 11:
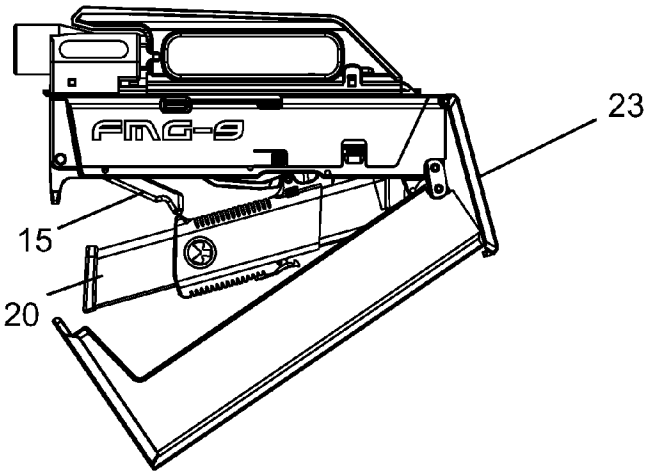
FIG. 11 is a right plan view of the firearm of FIG. 1, during later folding stages.
Figure 12:
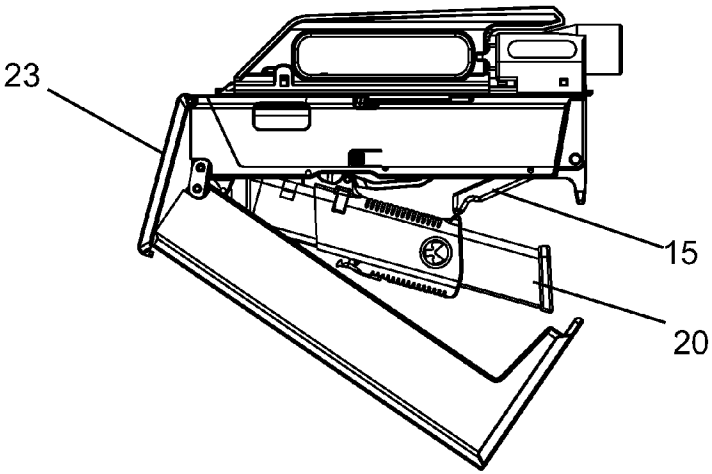
FIG. 12 is a left plan view of the firearm of FIG. 11.
Figure 13:
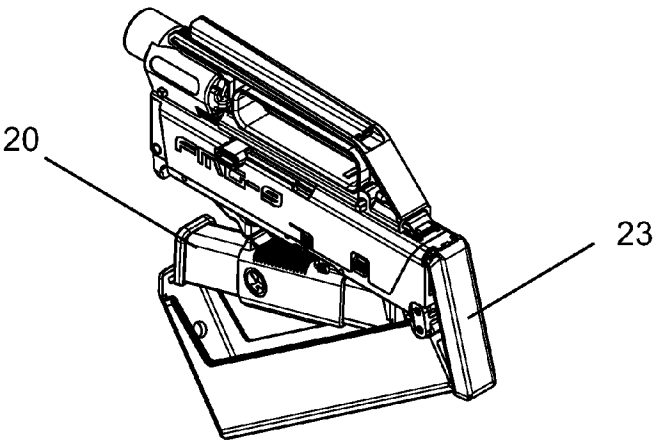
FIG. 13 is a rear perspective view of the firearm of FIG. 11.
Figure 16:
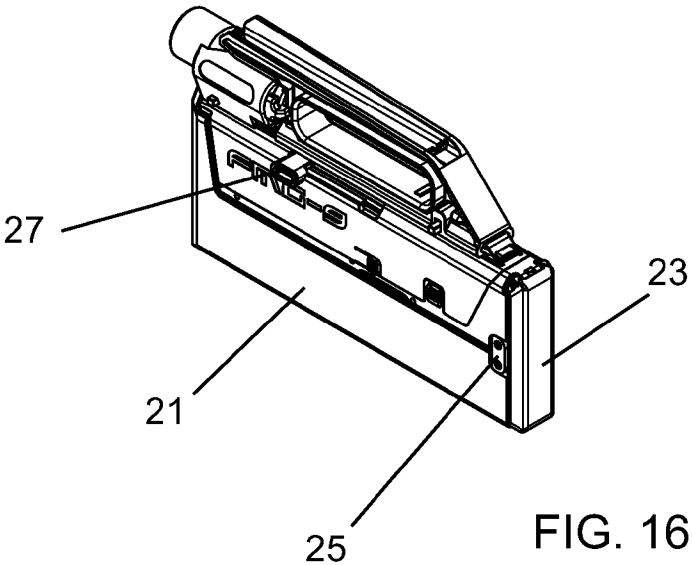
FIG. 16 is a rear perspective view of the firearm of FIG. 14.
Figure 15:
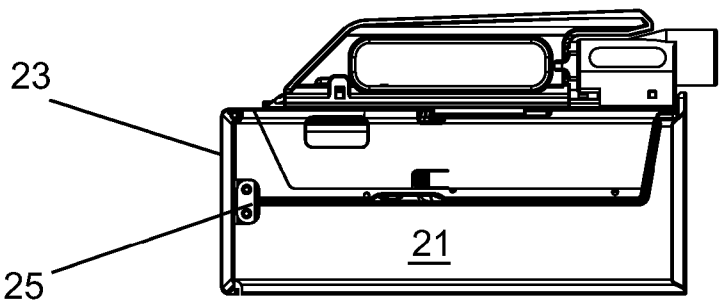
FIG. 15 is a left plan view of the firearm of FIG. 14.
Figure 14:
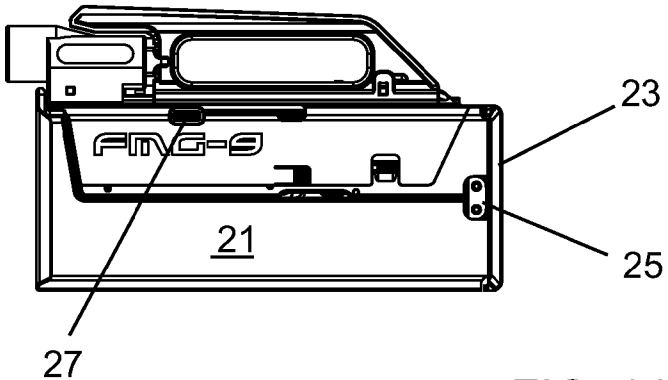
FIG. 14 is a right plan view of the firearm of FIG. 1, in a stowed orientation.

The firearm according to the present invention utilizes currently available aftermarket parts and more particularly utilizes GLOCK parts and mechanisms, including the upper receiver, slide 31, recoil guide rod 36 and spring 37, trigger bar 34 and firing mechanism 35. The casing materials are molded reinforced polymer for light weight, added strength and durability. A detachable handle 12 is also included (FIGS. 1 and 2) on the receiver 14, opposite the stock 21 when stowed. The firearm may be manufactured with a mounting rail 11, such as a PICATINNY rail (FIGS. 3 and 4). As such, the firearm may hold accessories, such as a light 13, while stowed or deployed. This allow its use as merely a light for night time security operations, while also allowing for rapid deployment. The firearm may be made to utilize any of the common pistol ammunition calibers, ranging from 9 mm to 0.45 caliber, however, 9 mm NATO is preferred due to availability of reliable high-capacity magazines available for the preferred GLOCK-based mechanism.

The steps of deploying the weapon (FIGS. 5-16) are as follows:

Step 1: User pulls back on charging handle 27 slightly which retracts the spur 28 that interfaces with toe of stock 21. This releases the weapon to unfold. The spur protrudes out the front of the weapon. The user may perform this step with a single hand.

Step 2: Spring loaded fore end grip 15 pushes down on end of grip 18 to help in opening and to provide momentum to the grip and magazine.

Step 3: Grip 18 unfolds and locks into position with grip catch 19 located in hand web area.

Step 4: Magazine 20 (which for high capacity magazines may be over-inserted into grip when closed) is forced out into locked loading position.

Step 5: Dual springs 24 acting on dual pivot linkage 25 in rear opens the stock 21.

Step 6: Back plate 23 is forced open against its own spring pressure which normally keeps it closed. The back plate 23 locks the stock 21 into place when fully opened and becomes a cheek plate.

The steps in stowing the weapon are as follows:

Step 1: Grip latch 19 is pushed releasing the grip 18. Grip 18 is folded up partially.

Step 2: Fore end grip 15 is fully depressed against spring pressure.

Step 3: Grip 18 is folded on top of fore end grip 15 and next to Receiver 14, totally removing the firing mechanism from any contact with stored ammunition.

Step 4: Magazine 20 is pushed in to collapse its profile (i.e. over-inserted into grip).

Step 5: Back Plate 23 is pulled out of engagement with the stock 21, also against spring pressure.

Step 6: Stock 21 is folded against spring pressure of the dual pivot springs 24.

Step 7: Stock 21 locks into place when the charging handle spur 28 engages and the slot 26 in the stock 21 and the back plate 23 flips over the joint.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A foldable firearm comprising:

a. receiver;

b. a stock, pivotally linked to the receiver by a double hinge, forming a joint, the receiver and stock foldable about the joint between a deployed position and a stowed position;

c. a spring connecting the stock and the receiver in a manner to bias them into a deployed position;

d. a plate hinged on a dorsal side of the receiver, said plate hinged in a manner to cover the joint when the receiver and stock are in the stowed orientation;

e. a hollow grip pivotally linked to the receiver, below the receiver and between an arc defined by the folding of the receiver and stock towards one another;

f. an ammunition magazine shaped and sized to be slidably inserted within the grip and interface with the receiver when the firearm is in the deployed position;

g. a trigger assembly collapsible between the hollow grip and receiver; and h. a firing mechanism, disposed within the receiver;

wherein the stock and receiver are in an end-to-end relation when the firearm is in deployed position and rotate together into a side-to-side relation, containing the trigger assembly, grip and magazine within and with a toe of the stock covering a barrel opening in the fore end of the firearm, when the firearm is in the stowed position.

2. The firearm of claim 1, further comprising a non-reciprocating charging handle.

3. The firearm of claim 2, the charging handle further comprising geometry to interface with the toe of the stock when the firearm is in the stowed position.

4. The firearm of claim 3, the firearm being maintained in the stowed position by an interface of the charging handle with the stock, and wherein a deployment process is initiated by charging the firearm to disengage the charging handle from the stock.

5. The firearm of claim 1, further comprising a fore grip, foldable into the receiver and underneath the hollow grip when the firearm is in the stowed position.

6. The firearm of claim 5, the fore grip being spring actuated into a deployed state.

7. The firearm of claim 1, wherein the magazine slides further into the grip, such that it is over-inserted, when the firearm is transitioned from the deployed position to the stowed position.

8. A foldable firearm comprising:

a. a receiver;

b. a stock, pivotally linked to the receiver such that the stock and receiver are foldable between a deployed position and a stowed position;

c. a hollow grip pivotally linked to the receiver, located below the receiver and between an arc defined by the folding of the receiver and stock towards one another;

d. an ammunition magazine shaped and sized to be slidably inserted within the grip and interface with the receiver when the firearm is in the deployed position;

e. a trigger assembly collapsible between the hollow grip and receiver;

f. a firing mechanism, disposed within the receiver; and g. a fore grip, foldable into the receiver and underneath the grip when the firearm is in the stowed position;

wherein the stock and receiver are in an end-to-end relation when the firearm is in the deployed position and rotate together into a side-to-side relation, containing the trigger assembly, grip and magazine within and with a toe of the stock covering a barrel opening in the fore end of the firearm, when the firearm is in the stowed position.

9. The firearm of claim 8, the fore grip being spring actuated into a deployed state.

10. The firearm of claim 8, further comprising a non-reciprocating charging handle.

11. The firearm of claim 10, the charging handle further comprising geometry to interface with the toe of the stock when the firearm is in the stowed position.

12. The firearm of claim 11, the firearm being maintained in the stowed position by an interface of the charging handle with the stock, and wherein a deployment process is initiated by charging the firearm to disengage the charging handle from the stock.

13. The firearm of claim 8, wherein the magazine slides further into the grip, such that it is over-inserted, when the firearm is transitioned from the deployed position to the stowed position.

14. The firearm of claim 8, the receiver and stock being pivotally linked by a double hinge that is spring loaded to bias the receiver and stock to the deployed position.

15. A foldable firearm comprising:

a. a receiver;

b. a stock, pivotally linked to the receiver such that the stock and receiver are foldable between a deployed position and a stowed position;

c. a hollow grip pivotally linked to the receiver, located below the receiver and between an arc defined by the folding of the receiver and stock towards one another;

d. an ammunition magazine shaped and sized to be slidably inserted within the grip and interface with the receiver when the firearm is in the deployed position and wherein the magazine slides further into the grip, such that it is over-inserted, when the firearm is transitioned from the deployed position to the stowed position;

e. a trigger assembly collapsible between the hollow grip and receiver;

f. a firing mechanism, disposed within the receiver; and wherein the stock and receiver are in an end-to-end relation when the firearm is in the deployed position and rotate together into a side-to-side relation, containing the trigger assembly, grip and magazine within and with a toe of the stock covering a barrel opening in the fore end of the firearm, when the firearm is in the stowed position.

16. The firearm of claim 15, further comprising a non-reciprocating charging handle.

17. The firearm of claim 16, the charging handle further comprising geometry to interface with the toe of the stock when the firearm is in the stowed position.

18. The firearm of claim 17, the firearm being maintained in the stowed position by an interface of the charging handle with the stock, and wherein a deployment process is initiated by charging the firearm to disengage the charging handle from the stock.

19. The firearm of claim 15, the receiver and stock being pivotally linked by a double hinge that is spring loaded to bias the receiver and stock to the deployed position.

* * * * *